US006537378B1

(12) United States Patent
Mauchle

(10) Patent No.: US 6,537,378 B1
(45) Date of Patent: Mar. 25, 2003

(54) SPRAY-COATING APPARATUS

(75) Inventor: Felix Mauchle, Abtwil (CH)

(73) Assignee: ITW Gema AG, St. Gallen (CH)

( * ) Notice: Subject to any disclaimer, the term of this patent is extended or adjusted under 35 U.S.C. 154(b) by 82 days.

(21) Appl. No.: 09/593,297

(22) Filed: Jun. 13, 2000

(30) Foreign Application Priority Data

Jun. 19, 1999 (DE) ..... 99-19712

(51) Int. Cl.[7] ..... B05C 11/10

(52) U.S. Cl. ..... 118/671; 118/679; 118/712; 118/629

(58) Field of Search ..... 118/663, 671, 118/679, 712, 621, 629, 630, 308

(56) References Cited

U.S. PATENT DOCUMENTS

| | | | | |
|---|---|---|---|---|
| 3,893,006 A | | 7/1975 | Algeri et al. | |
| 4,000,443 A | | 12/1976 | Lever | |
| 4,075,677 A | | 2/1978 | Bentley | |
| 4,187,527 A | | 2/1980 | Bentley | |
| 4,764,393 A | | 8/1988 | Henger et al. | |
| 5,584,931 A | | 12/1996 | Buhlmann | |
| 5,720,436 A | * | 2/1998 | Buschor | 239/600 |
| 5,735,958 A | | 4/1998 | Mauchle | |
| 6,068,877 A | * | 5/2000 | Seitz et al. | 427/477 |

FOREIGN PATENT DOCUMENTS

| | | | |
|---|---|---|---|
| DE | 3445946 | A1 | 6/1986 |
| DE | 2759787 | C2 | 12/1988 |
| EP | 0 160 179 | B1 | 10/1988 |
| EP | 0 620 045 | A1 | 10/1994 |
| EP | 0 626 209 | A1 | 11/1994 |
| EP | 0 559 608 | B1 | 12/1995 |
| EP | 0734779 | A2 * | 10/1996 |
| EP | 0 626 208 | B1 | 11/1998 |
| GB | 2 077 006 | | 12/1981 |
| WO | WO 99/25483 | | 5/1999 |

* cited by examiner

*Primary Examiner*—Richard Crispino
*Assistant Examiner*—George R. Koch, III
(74) *Attorney, Agent, or Firm*—Lowe Hauptman Gilman & Berner, LLP

(57) ABSTRACT

Spray coating apparatus comprises a spray nozzle (2) and a regulation system (16) which limits the high voltage at a high-voltage electrode (10) to a predetermined voltage value. The system also directly measures and limits the electric spray current of the high-voltage electrode (10) to a predetermined current value. The electric spray current is limited by adjusting the high voltage at the high-voltage electrode (10).

6 Claims, 2 Drawing Sheets

SPRAY-COATING APPARATUS

BACKGROUND ART

The invention relates to a spray-coating apparatus with direct spray current measurement.

Spray-coating equipment is known from the European patent document 0160,179 B1. Through a keypad, an operator applies a desired voltage and a desired electric current that shall be kept constant by a regulation system. A threshold value applies to the distance between the spray equipment and the object to be coated. If the distance exceeds the threshold value, the high voltage at the high-voltage electrode of the spray equipment is kept constant independently of increasing object distance, the electric spray current of the high-voltage electrode decreasing as the object distance increases and increasing as it becomes smaller. When the distance is less than the said threshold value, the electric spray current is kept constant independently of changes in this distance because an increase in current being counteracted by a commensurate drop in voltage. Just before the object comes into contact with the spray equipment, the high voltage collapses entirely (contact protection). The electric current between the electrode and the object to be coated is determined indirectly by measuring the electric current in the primary of a transformer of which the secondary feeds a high-voltage cascaded circuit having rectifiers and capacitors generating the electrode's high DC voltage DC.

U.S. Pat. No. 4,000,443 discloses spray equipment wherein a rise in the electric spray current when an object to be coated nears said equipment is counteracted by a commensurate reduction in the high voltage. The electric spray current is measured indirectly by the current in the secondary between the transformer and the high-voltage cascaded circuit. The European patent document 0,626,208 B1 discusses spray equipment wherein again the input voltage at a high-voltage generator is varied inversely to the current, the electric spray current being measured indirectly as a voltage drop across a resistor preceding the high-voltage electrode. It is known from the British patent 2,077,006 to counteract a rise in the electrode spray current by commensurately reducing the level of the high voltage within a predetermined operational window. U.S. Pat. No. 4,187,527 compares test values of electric spray currents measured in rapid succession when there is a sharp current rise indicating a short, in order to shut off the current.

The European patent document 0,559,608 B1 discloses measuring the current between the high-voltage electrode and the object to be coated using a meter mounted in the electrical path between said object and ground.

SUMMARY OF THE INVENTION

The objective of the invention is to solve the problem of preventing the dangers relating to excessively high voltages at the high-voltage electrode when there is a large distance from an electrically conducting object, or an excessively high current, or short, when the object is too near the object, where the object may be something to coat or an operator or something else, and at the same time to design the spray coating apparatus in such manner that optimal coating shall be achieved at minimal energy consumption.

This problem is solved by a direct measurement of the electric spray current in the return path from the object to be coated. As a result, true test results are provided and rapid response of the regulation system to deviations of instantaneous values from the reference values is achieved.

In especially advantageous manner of the invention, it contains a counter electrode at a potential substantially differing from that of the high-voltage electrode and for instance at ground in order that free electric particles, in particular that freely wandering ions and electrodes produced by the high-voltage electrode shall be shunted instead of accompanying the spray-coating material from the spray apparatus onto the object to be coated. Counter electrodes are known for instance from the European patent document 0,756,899 A2.

BRIEF DESCRIPTION OF THE DRAWINGS

The invention is elucidated below by means of an illustrative embodiment shown in the attached drawings.

DETAILED DESCRIPTION OF THE INVENTION

Figure 1:
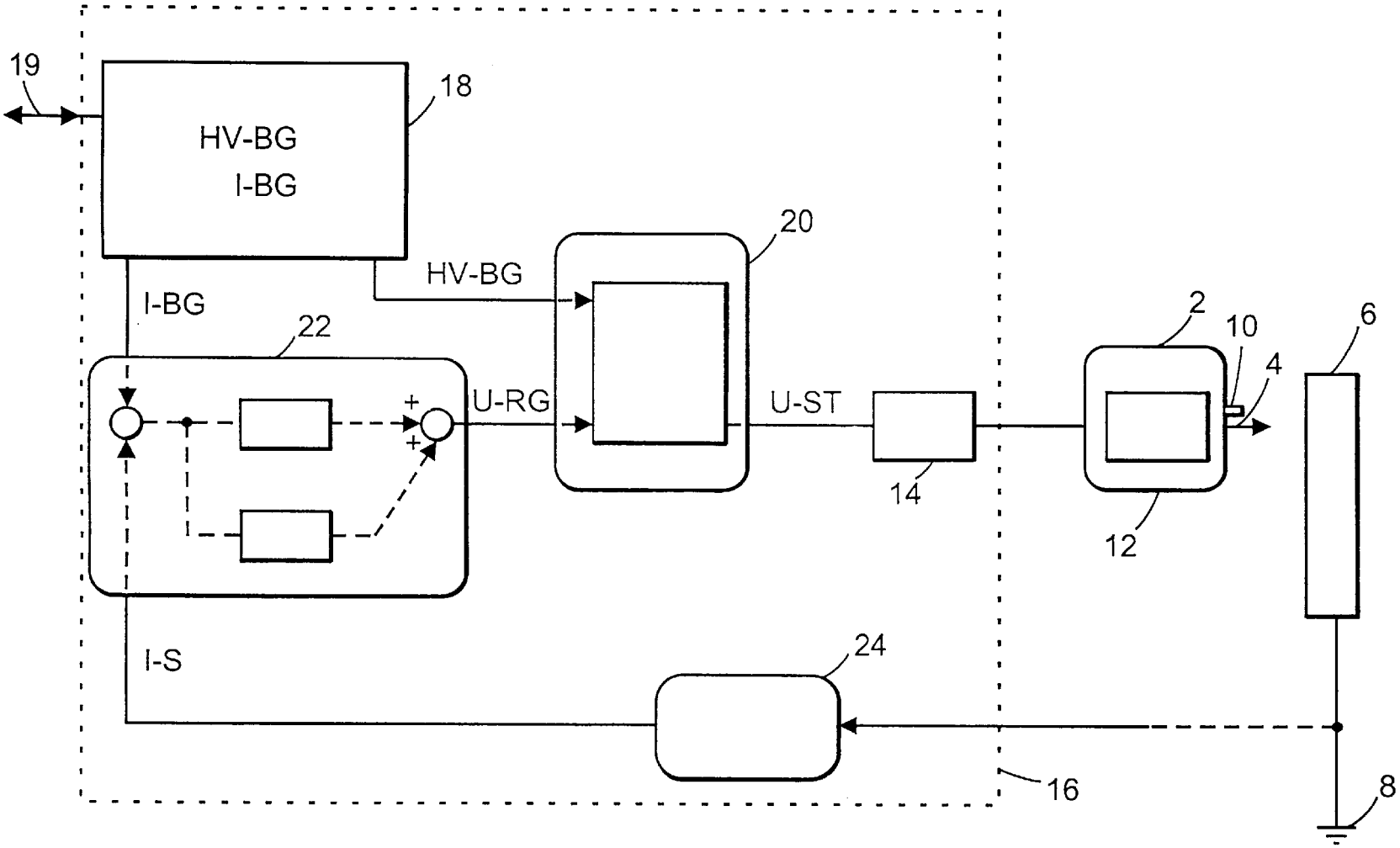
FIG. 1 is a block diagram of the spray coating apparatus of the invention.

The spray-coating apparatus shown in block form in FIG. 1 comprises a spray nozzle 2 to spray a liquid or preferably powder material 4 on an object 6 to be coated. It is assumed that the objects to be coated are electrically conducting and are at ground 8. In automated facilities, the objects 6 are moved by an omitted conveyor past the spray nozzle 2 and in this manner enter a spray jet denoted by the arrow of the coating material 4.

The nozzle 2 is fitted with at least one high-voltage electrode 10 for the purpose of electrostatically charging the coating material 4 and with a high DC voltage source 12 delivering a high DC voltage which is preferably within the range from 1 to 150 kv and is applied to said electrode. The high-voltage source may be a conventional transformer to step up a low AC voltage into a higher one and a cascaded circuit which contains in manner known per se a plurality of rectifiers and capacitors and converts the AC into the high-voltage DC.

The low-voltage AC is generated by an oscillator 14 as a function of a control voltage U-ST controlling the high-voltage applied to the high-voltage electrode 10. The oscillator 14 may be part of the high-voltage source 12 and as such may be integrated into the nozzle 2, or, as shown in FIG. 1, it may be integrated into a control unit which as a whole operates as a regulation system 16.

The regulation system 16 contains an operational-parameter memory 18. At least one variably adjustable high-voltage limit-value HV-BG and at least one electric-spray current limit-value I-BG for the maximum possible values at the high voltage electrode can fed through a data transfer path 19 into said memory 18 and be stored in it. Preferably several such values relating to different operational states, in particular to different objects to be coated and to different spray materials, can be stored in said memory. In another embodiment of the invention, said stored values may be immutably fixed values.

The operational-parameters memory 18 feeds the high-voltage limit value HV-BG into a high-voltage limiting circuit 20. The limiting-value I-BG for the electric spray current is fed from the operational parameters memory 18 to an electric spray current regulator 22.

The electric spray current of the high-voltage electrode 10 from an object to be coated 6 to ground 8 is measured by an electric-spray current circuit 24 on the side of the object 6 connected to ground and is fed also as the instantaneous electric-spray-current value I-S to the electric-spray-current regulator.

The electric-spray-current regulator 22 compares the instantaneous electric-spray current I-S with the electric-spray-current limiting value I-BG and as a function of this comparison generates a high-voltage regulating value U-RG which is applied from the electric-spray current regulator 22 to the high-voltage limiting-circuit 20. Preferably the electric-spray-current regulator 22 is a PI (proportional integral) control.

As a function of the high-voltage limiting value HV-BG and of the high-voltage regulator value U-RG, the high-voltage limiting circuit 20 generates the control voltage U-ST which, in the form of a DC input voltage is fed to the oscillator 14 and represents the high-voltage setpoint for the high-voltage electrode 10.

In the event the high-voltage regulator value U-RG is larger than or equal to the high-voltage limiting value HV-BG, the high-voltage limiting circuit 20 assures that the DC value of the control voltage U-ST shall be equal to the high-voltage limiting value HV-BG. Moreover the high-voltage limiting circuit 20 assures that, in all cases of the high-voltage regulator value U-RG being smaller than the high-voltage limiting value HV-BG, the control voltage U-ST shall be equal to the high-voltage regulator value U-RG. These constraints may be stated as follows:

when $$U\text{-}RG \geqq HV\text{-}BG$$

then $$U\text{-}ST = HV\text{-}BG$$

otherwise $$U\text{-}ST = U\text{-}RG.$$

Figure 2:
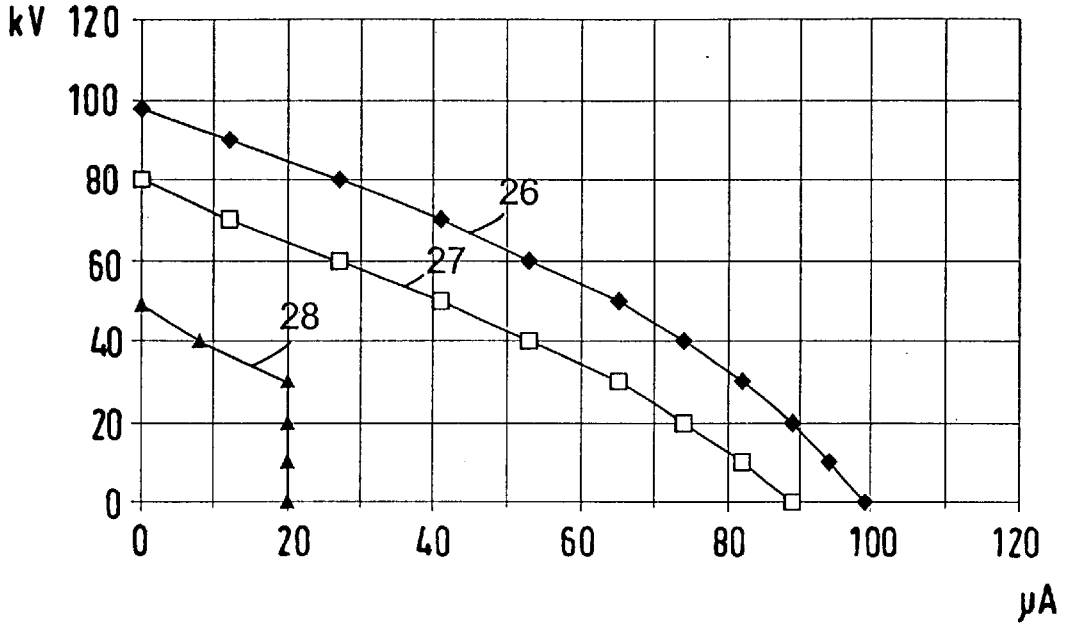
FIG. 2 is a plot of high-voltage vs electric spray current for the spray coating apparatus of FIG. 1.

FIG. 2. shows the electric spray current in $\mu$a on the abscissa and the corresponding high voltage in kv on the ordinate. The top function 26 [solid squares] is a standard characteristic line. It shows that in known equipment the electric spray current of the high-voltage electrode rises as the distance between said electrode 10 and object 6 to be coated decreases and how the high-voltage at the same time drops. The high voltage is at its maximum at the largest possible distance away, ie at infinity, of the object 6 to be coated, or another electrically conducting object, from the high-voltage electrode 10.

The center curve 27 [empty squares] relates to an embodiment wherein the maximum DC high voltage of the high-voltage electrode 10 is limited to a maximum value HV-GB of 80 kv, no current limitation I-BG taking place.

The lowermost curve 28 [solid triangles] will materialize in the above circuit of the invention when both the high voltage and the electric spray current are limited to a maximum value each. It was assumes in FIG. 2 that the high-voltage limiting value HV-BG is 50 kv and the electric-spray current limiting value I-BG is 20 $\mu$a ($20\times10^{-6}$a).

Figure 3:
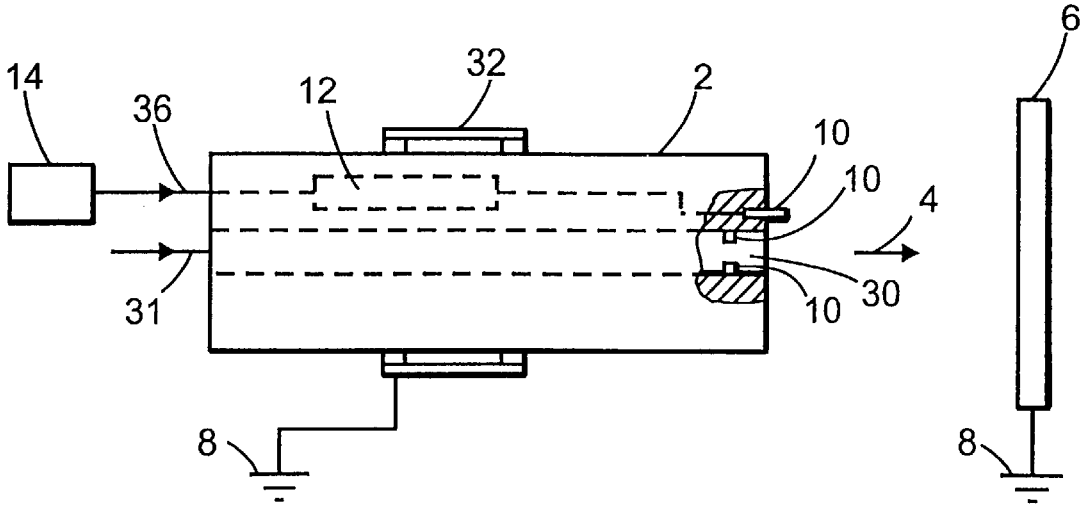
FIG. 3 is a diagram of a spray nozzle of the spray coating apparatus of FIG. 1.

The nozzle 2 is shown is somewhat greater detail in FIG. 3. It shows that one or more high-voltage electrodes can be mounted outside or inside a coating-material duct 30. This duct 30 is loaded with coating material, for instance a coating powder, through a line 31, for instance a hose.

As shown by FIG. 3, the spray nozzle 2 can be fitted with mating electrodes 32 (shunt electrodes) which collect free electrical charges (electrons, ions) discharged from the electrodes 10 and shunt them to ground. It was observed that substantially fewer free electric particles, in particular free ions, are generated in the invention, and that accordingly there is also smaller current leakage.

In FIG. 3 the oscillator 14 is connected by an electric cable 36 to the high-voltage source 12 integrated into the nozzle 2, though it also may be mounted separately from said nozzle, for instance in the regulator system 16.

What is claimed is:

1. A spray-coating apparatus, comprising:

a spray nozzle for spraying a coating material onto an electrically conductive object to be coated;

at least one high-voltage electrode for electrostatically charging the coating material sprayed from said spray nozzle;

a high-voltage source for applying a high voltage to said high voltage electrode, the high voltage causing the electrostatically charged coating material to move towards the object to be coated resulting in a spray current; and a regulation system for measuring and regulating the spray current so that the spray current does not exceed a predetermined spray current limiting value, said system being electrically connected to the object to be coated by a return path;

wherein said regulation system comprises a spray current measuring circuit installed in the return path for measuring an instant value of the spray current flowing therein; and a control circuit coupled to the spray current measuring circuit for regulating the high voltage applied to said high voltage electrode based on the measured instant value of the spray current;

wherein said regulation system further regulates the high voltage applied to said high voltage electrode so that the high voltage does not exceed a predetermined high voltage limiting value;

wherein said control circuit comprises a current comparator coupled to the spray current measuring circuit for receiving and comparing the measured instant value of the spray current against the spray current limiting value, and generating a high voltage regulating value based on said spray current value comparison; and a voltage comparator coupled to the spray current comparator for receiving and comparing the high voltage regulating value against the high voltage limiting value, and generating a control voltage based on said high voltage value comparison.

2. The apparatus of claim 1, wherein the control voltage is fed to said high voltage source for adjusting the high voltage applied to said high voltage electrode.

3. The apparatus of claim 2, wherein said high voltage source has a high voltage part for generating the high voltage to be applied to said high voltage electrode, and a low voltage part for receiving the control voltage and adjusting the high voltage based on the received control voltage.

4. The apparatus of claim 3, wherein the low voltage part of said high voltage source comprises an oscillator.

5. The apparatus of claim 1, wherein the current comparator is a proportional-integral control.

6. The apparatus of claim 1, further comprising a memory for storing the spray current limiting value and the high voltage limiting value, said memory being coupled to the current and voltage comparators for feeding the stored spray current limiting value and high voltage limiting value thereto, respectively.

* * * * *